United States Patent [19]

Knight et al.

[11] 4,288,310

[45] Sep. 8, 1981

[54] MEMBRANE SUPPORT ASSEMBLY FOR ELECTROLYTIC CELL AND METHOD OF MAKING SAME

[76] Inventors: Allan R. Knight, 437 Crescent Park, Petrolia, Ontario N0N 1R0, Canada; Indresh Mathur, 939 Cathcart Blvd., Sarnia, N7V 2P1 Ontario, Canada

[21] Appl. No.: 74,640

[22] Filed: Sep. 12, 1979

[51] Int. Cl.[3] ..... C25B 9/00; C25B 13/02; C25B 13/08; C25B 1/16

[52] U.S. Cl. ..... 204/252; 204/98; 204/128; 204/266; 204/296; 204/258; 264/251; 264/252

[58] Field of Search ..... 204/252-258, 204/263-266, 295-296, 98, 128; 264/251, 252

[56] References Cited

U.S. PATENT DOCUMENTS

| | | | |
|---|---|---|---|
| 3,923,630 | 12/1975 | Argade et al. | 204/295 X |
| 4,153,530 | 5/1979 | Vallance et al. | 204/296 X |
| 4,156,639 | 5/1979 | Vallance et al. | 204/296 X |

*Primary Examiner*—Aaron Weisstuch
*Assistant Examiner*—D. R. Valentine
*Attorney, Agent, or Firm*—Merton B. Lilly

[57] ABSTRACT

Method of supporting a preformed membrane in an electrolytic cell, and apparatus therefor, which comprises casting in situ support plates about the open edges of the membrane.

15 Claims, 4 Drawing Figures

MEMBRANE SUPPORT ASSEMBLY FOR ELECTROLYTIC CELL AND METHOD OF MAKING SAME

BACKGROUND

Diaphragm electrolytic cells have been used widely in the production of chlorine and caustic from brine. It is conventional in such cells to employ elongated, hollow finger-shaped cathodes with graphite anodes interdigited between the cathodes. The asbestos diaphragm is customarily deposited in situ on the cathode so as to divide the interior of the cell into a catholyte and an anolyte compartment. Among recent developments have been new, long lasting metal anodes, along with preformed membranes made of polymeric materials which may be either semipermeable (allow only ions to permeate them) or hydraulically-permeable (allowing the electrolyte to permeate them). In spite of the increase of life of these preformed membranes, as well as a number of additional advantages, there is still the problem of fitting these membranes between the cathodes and the anodes in the cell to form fluid tight catholyte and anolyte compartments. These membranes must be fitted over either the anodes or the cathodes and do not naturally adhere to the electrodes as do the asbestos diaphragms which have, for the most part, been formed in situ on one electrode or the other.

As would be expected, those skilled in the art have sought an answer to this particular problem. U.S. Pat. No. 3,980,544 discloses complex clamping means, requiring major modifications in the electrolytic cells now in use. Any deviation of any of the metal clamp parts disclosed in this patent presents a possibility for a leak. U.S. Pat. No. 3,878,082 discloses and claims resilient means for holding the diaphragm in place, but does not detail how the open edges of the diaphragm or membrane sheet are to be sealed. U.S. Pat. No. 3,923,630 discloses a cylindrical, continuous sheet of preformed membrane positioned about a cylindrical electrode and held in place by being glued or sealed to upper and lower membrane supports. In actual practice, it is extremely difficult to completely seal the entire edge of these membrane sheets for the fifty or more electrodes included in each electrode section, and this task is multiplied many times when one considers that a large plant for producing chlorine and caustic may have several thousand electrodes.

SUMMARY

In electrolytic diaphragm cells for the production of chlorine and caustic wherein a plurality of cathodes are spaced from one another and a plurality of anodes are interposed in the spaces between the cathodes, an improved membrane support assembly, and method of making same, has been devised which comprises a continuous, elongated sheet of preformed membrane positioned in serpentine fashion between the anodes and the cathodes so as to separate all opposing surfaces of anodes and cathodes, a first membrane support plate cast in situ embedding one serpentine-shaped edge of said membrane, and a second membrane support plate cast in situ embedding the other serpentine-shaped edge of said membrane, said membrane assembly dividing said electrolytic cell into separate anolyte and catholyte compartments.

DETAILED DESCRIPTION

The present invention is illustrated in the accompanying drawings, wherein

Figure 1:
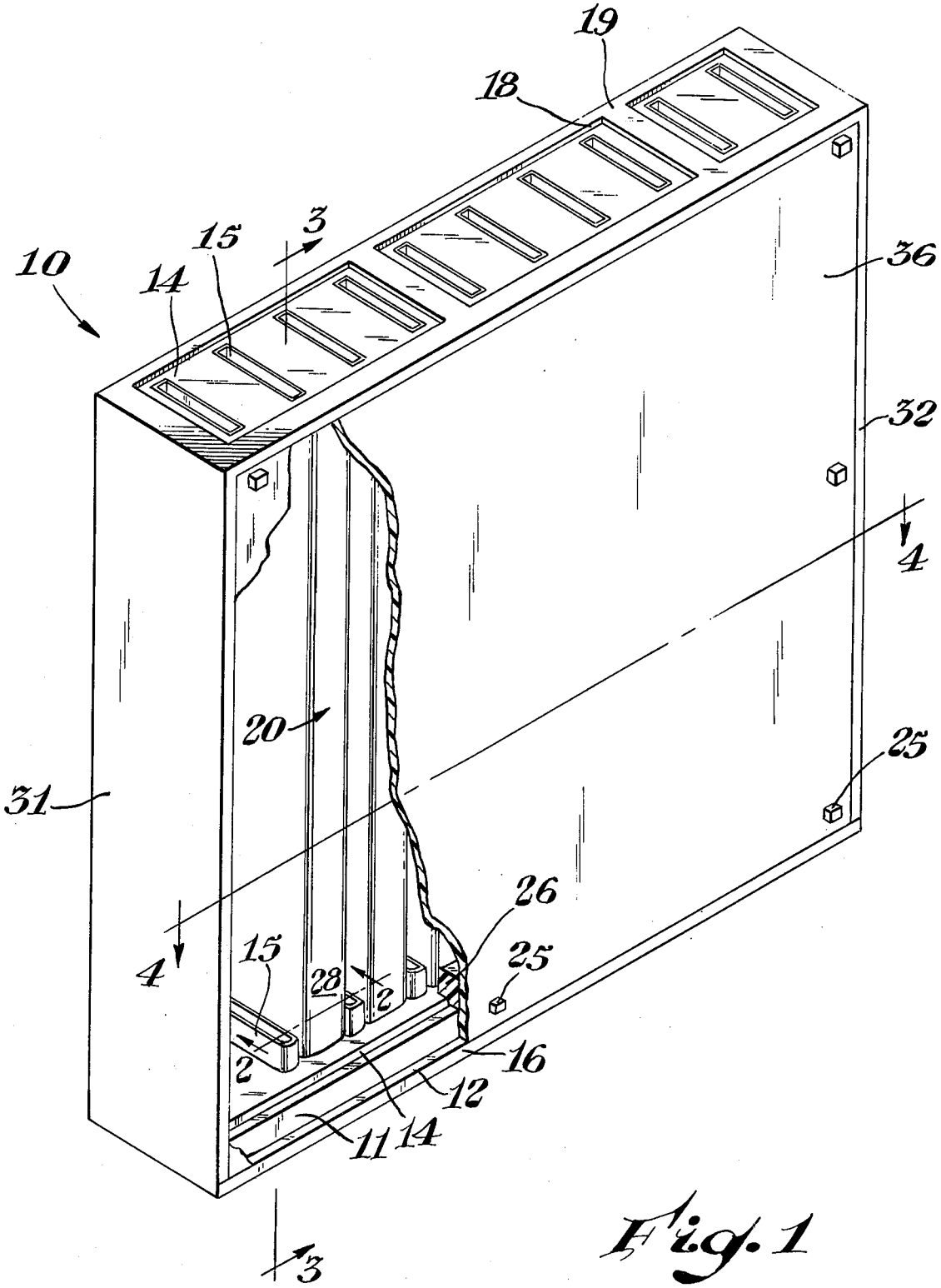
Figure 2:
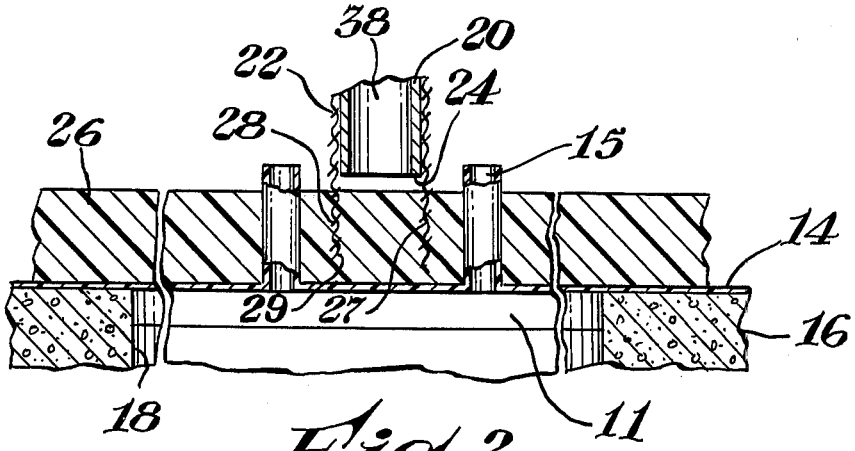
Figure 3:
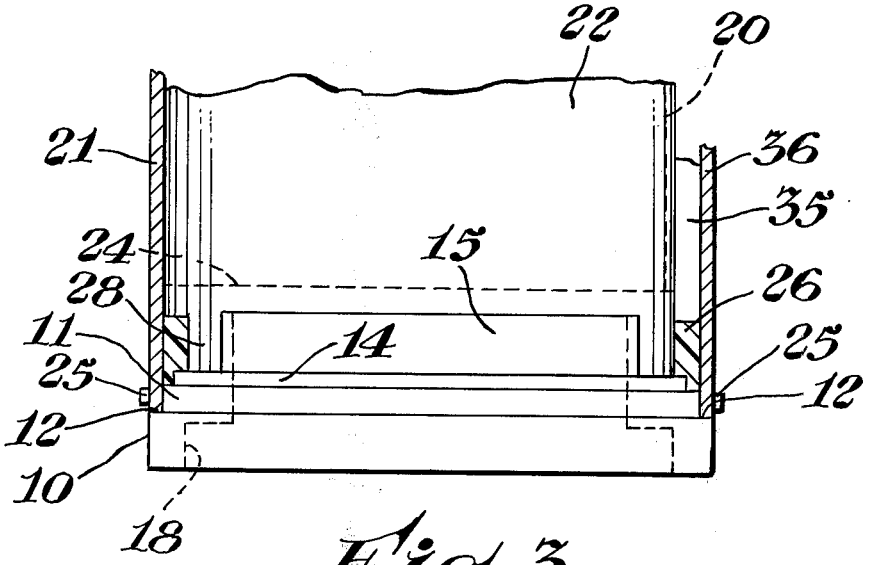
Figure 4:
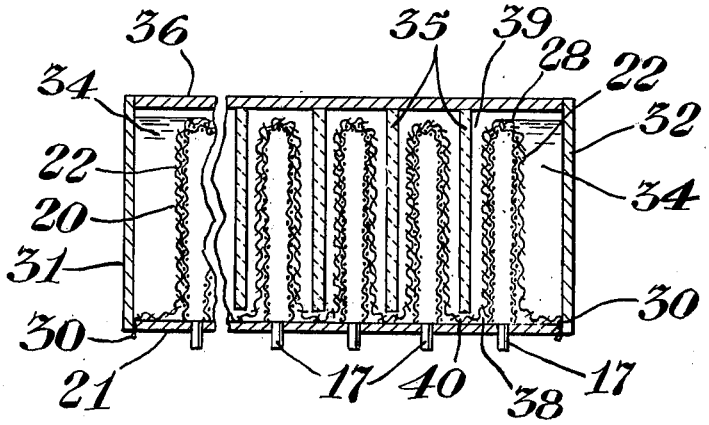

FIG. 1 is a perspective view of an electrolytic cell partially in section and shown in a partially assembled state, FIG. 2 is an enlarged, cross-sectional view taken on line 2—2 of FIG. 1, FIG. 3 is an enlarged, cross-sectional view taken on line 3—3 of FIG. 1 and at right angles to FIG. 2, and FIG. 4 is a cross-sectional view taken on line 4—4 of FIG. 1.

In practicing the present invention, a conventional cell frame 10 is constructed with an inner raised member 11 extending around the entire inner perimeter of the cell frame. The raised member 11 is so formed as to provide ledges 12 which likewise extend around the interior of the perimeter of the cell frame on either side of the raised member 11. The raised member 11 may be an integral part of the cell frame 10, and is so shown in the accompanying drawings. The cell frame itself may be composed of cement, a poured plastic such as polymeric resins, mixtures of polymeric resins with various types of fillers, or any material which is sufficiently strong, relatively non-electrically conducting and non-reactive with the cell environment.

In the embodiment shown in the drawings, an elongated footing strip 14 (see FIG. 2) of polymeric resin having raised slots 15 molded therein is glued to the raised member 11 along the bottom 16 of the cell frame. Slots 15 are aligned with openings 18 in the cell frame so as to permit electrolyte to flow in through the bottom 16 of the cell frame and through the anolyte compartment 39. Chlorine passes out of the anolyte compartment 39 through slots 15 in the top 19 of the cell frame, as hereinafter described. An identical footing strip 14 with identical slots 15 is glued to the top 19 of the cell frame. Here the slots 15 are also aligned with openings 18 in the top of the cell frame and provide vents for the chlorine formed in the anolyte compartment of the cell.

A series of hollow finger-shaped cathodes 20, made of wire mesh, are bolted to a steel cathode backboard 21. Cathodes 20 are spaced from one another but in parallel alignment with each other. Outlets 17 are provided in the backboard 21 for hydrogen and for cell effluent from the catholyte compartment (hereinafter fully defined). The cathode backboard 21, with the cathodes attached, is laid on its back and continuous elongated preformed membrane sheet 22 is laid over the cathodes 20 in a serpentine shape, as best seen in FIG. 4. This preformed membrane sheet performs broadly the function generally ascribed to a "diaphragm" in the electrolytic cell. It may be composed of an inert, flexible material which is fluid permeable or one which permits only the passage therethrough of ions (referred to in the art as semipermeable membranes). Such membranes are well known in the art and may be composed of any one of many polymeric, synthetic resins. A preferred composite membrane comprises a perfluorosulfonic acid resin supported by a polyfluoroolefin fabric, and is sold commercially by E. I. duPont de Nemours and Company under its trademark "Nafion".

The preformed membrane sheet 22 is of sufficient width to overhang along its serpentine edges 28 both top and bottom ends 24 of the cathodes 20 (see FIG. 2). Elastomeric, foamed pieces (not shown) may be used to hold the serpentine shaped membrane 22 in position, while the entire backboard 21, with cathodes 20 attached, is tipped on end, as shown in FIG. 1. This assembly is then moved into the cell frame 10 so that the cathodes are positioned between the raised slots 15 positioned at the top and bottom of the cell frame. The cathode backboard 21 rests in the cell frame on the ledges 12, and is attached to the cell frame 10 by bolts 25 positioned along the perimeter of the backboard.

A molding board (not shown) is seated temporarily in that portion of the ledge 12 which runs along the bottom 16 of the cell frame opposite the cathode backboard 21. A lower membrane support plate 26 is cast in situ by pouring a casting material along the bottom footing strip 14 (note FIG. 2). Sufficient casting material is poured along the footing to embed the serpentine edges 28 of the membrane sheet 22 in the casting material. The tops of slots 15, however, should not be covered, since this would prevent the introduction of the brine into the cell. Also, in the embodiment shown, the ends of the cathodes 20 were not embedded in the support plate 26. The lower membrane support plate 26 should be cast in a single pour. If the pour is stopped after the level of the casting material reaches bottom 29 of the serpentine edges 28 of the membrane sheet 22, the already hardened material would prevent the casting material of the second pour from filling in on the backside 27 of the membrane sheet to further embed the serpentine edges 28 (see FIG. 2).

An inorganic or organic cementitious material, a polymeric synthetic resin or a material which is the same as or similar to the composition of the cell frame, may be employed as the casting material. This casting material must wet the membrane to form a fluid-tight seal therewith. Furthermore, the casting material should not be attacked by the environment of the electrolytic cell and must be castable at a temperature that does not melt or weaken the membrane sheet. Obviously, the casting material must be sufficiently fluid in the casting state to flow up and around the serpentine edges 28 of the membrane sheet to embed the same in the resulting membrane support plate 26. Vinyl ester resins have been found to be useful as a casting material for the support plates, particularly the reaction product of an unsaturated monocarboxylic acid and a polyepoxide in about equivalent amounts. Fillers, such as sand, may be added to the casting material to provide a heat sink and thus minimize shrinkage upon cooling. After the lower membrane support plate 26 has hardened, the cell frame 10 is reversed so that it rests on the top 19 of the cell frame. At this point an upper membrane support plate (not shown) is cast in exactly the same manner as that heretofore described in connection with the lower membrane support plate 26. The straight (non-serpentine) edges 30 of the membrane sheet 22 which parallel the two sides 31 and 32 of the cell frame, may be sealed in place by laying the cell frame on its back so that it rests on the cathode backboard 21. Casting material 34 is then poured along the interior of the two sides 31 and 32, as shown in FIG. 4. In the particular embodiment shown, edges 30 of membrane 22 are wedged between backboard 21 and cell frame sides 31 and 32. Clamps or other types of seals may, or course, be used to provide a fluid-tight seal for the edges 30. The cell is completed by inserting in the cell frame 10 a plurality of anodes 35 held in parallel alignment with one another by means of an anode backboard 36, as shown in FIG. 4. It will be further apparent from FIG. 4 that each of the anodes 35 is interposed or interdigited between each of the cathodes 20.

Again referring to FIG. 4, it is seen that the membrane support assembly, consisting of the membrane sheet 22 and the upper (not shown) and lower membrane support plates 26 divide the interior of the cell into fluid-tight catholyte compartment 38 and an anolyte compartment 39. The trough portion 40 of the membrane sheet is held in place by the embedment of the serpentine edges 28 in the upper and lower membrane support plates, but is otherwise entirely free of mechanical means that could perforate the relatively fragile membrane sheet 22.

It will be apparent from the above detailed description that the present invention provides means for securely holding the serpentine-shaped membrane sheet 22 in a fluid-tight arrangement which is economical to produce and one which can be readily adapted to electrolytic cells for producing chlorine and caustic which are currently in general industrial use. The trough portions 40 of the membrane sheet 22, which run the entire length of the cathodes, are free from clamps of any kind and are merely held at the edges by the cast-in-place membrane support plates. The improved membrane support assembly is so constructed that both the anodes and the cathodes may be removed from the cell frame without disturbing the membrane sheet 22.

Numerous variations in the embodiment of the invention illustrated in the accompanying drawings will be apparent to those skilled in the art without departing from the scope of the present invention as described in the claims. For example, the "continuous" membrane sheet may in fact be made up of a plurality of short membrane sheets spliced to one another either by gluing or heat sealing. The exact construction of the cell frame 10, or the particular shape of the cathodes and anodes employed in the cell form no part of the present invention, and may be varied widely. For example, hollow, expanded mesh anodes may be employed in place of the solid anodes shown, and punched plate cathodes may be employed in place of the wire mesh cathodes shown.

What is claimed is:

1. In an electrolytic cell for the production of chlorine and caustic from aqueous alkali metal chloride solutions comprising a plurality of cathodes spaced from one another and a plurality of anodes interposed between said cathodes and spaced therefrom, an improved membrane support assembly which comprises a continuous, elongated sheet of preformed membrane positioned in serpentine fashion between the anodes and the cathodes so as to separate all opposing surfaces of anodes and cathodes, a first membrane support plate cast in situ embedding one serpentine-shaped edge of said membrane, and a second membrane support plate cast in situ embedding the other serpentine-shaped edge of said membrane, said membrane support assembly dividing said electrolytic cell into separate anolyte and catholyte compartments.

2. In an electrolytic diaphragm cell for the production of chlorine and caustic from aqueous alkali metal chloride solutions comprising a plurality of hollow porous finger-shaped cathodes aligned in parallel but in spaced relationship to one another and a plurality of anodes interdigited between and spaced from said cathodes, an improved support assembly which comprises a continuous elongated preformed membrane sheet positioned in serpentine fashion between the anodes and the cathodes so as to separate all opposing surfaces of the anodes and the cathodes, a first membrane support plate cast in situ embedding one serpentine-shaped edge of said membrane, a second membrane support plate cast in situ embedding the other serpentine-shaped edge of said membrane and means for sealing the non-serpentine edges of the membrane sheet which comprise a sealant cast in situ so as to embed all of the non-serpentine edges of said membrane sheet.

3. The improved membrane support assembly defined in claim 1 wherein said membrane sheet is a composite membrane composed of a perfluorosulfonic acid resin supported by a polyfluoroolefin fabric.

4. In an electrolytic cell for the production of chlorine and caustic from aqueous alkali metal chloride solutions comprising a plurality of cathodes spaced from one another, a plurality of anodes interposed in the spaces between said cathodes and separated therefrom and a continuous elongated preformed membrane sheet separating the anodes and the cathodes from one another so as to provide separate anolyte and catholyte compartments within said cell, a method for making an improved membrane support assembly which comprises positioning said continuous preformed membrane sheet in serpentine shape between said anodes and cathodes so as to separate all opposing surfaces of said anodes and cathodes, casting a first membrane support plate about one serpentine-shaped edge of said membrane sheet so as to fixedly embed said edge in said support plate, and casting a second membrane support plate about the other serpentine-shaped edge of said membrane so as to fixedly embed said other edge in said support plate, said membrane support assembly thus forming separate anolyte and catholyte compartments within said electrolytic cell.

5. The method of claim 4 wherein the membrane is a polymeric synthetic resin.

6. The method of claim 4 including casting the serpentine-shaped edges of said membrane sheet in an inorganic or organic cementitious material or a polymeric synthetic resin.

7. The method of claim 4 including casting in situ a sealant around non-serpentine edges of the membrane to embed at least a portion of such edges in the sealant and to adhere the edges to at least a wall portion of the cell.

8. The method of claim 4 wherein the membrane is a perfluorosulfonic acid resin supported by a polyfluoroolefin fabric.

9. The method of claim 4 wherein each of the membrane support plates is cast to fully embed both sides of the membrane sheet.

10. The method of claim 9 wherein each of the membrane support plates is cast in a single pour.

11. In an electrolytic cell for the production of chlorine and caustic from aqueous alkali metal chloride solutions having a plurality of cathodes mounted therein and a plurality of anodes positioned between said cathodes, the improvement which comprises a membrane support assembly composed of an upper membrane support, a lower membrane support, a continuous, elongated preformed membrane sheet positioned in serpentine fashion between the anodes and the cathodes in said cell, the upper and lower edges of said membrane sheet being embedded in situ in the upper and lower membrane supports, respectively, said upper and lower membrane supports being composed of a polymeric material that wets said membrane sheet so as to form a liquid impermeable seal with the embedded portion thereof.

12. In an electrolytic cell for the production of chlorine and caustic from aqueous alkali metal chloride solutions having a plurality of anodes mounted therein, a plurality of cathodes positioned between said anodes and a continuous elongated preformed membrane sheet composed of a non-conductive polymeric composition placed between the anodes and the cathodes in the cell so as to divide the cell into anolyte and catholyte compartments, the improvement which comprises a membrane support assembly composed of an upper membrane support, a lower membrane support, a continuous elongated preformed membrane sheet positioned in serpentine fashion between the anodes and the cathodes in said cell, the upper and lower edges of said membrane sheet being embedded in situ in the upper and lower membrane supports, respectively, said upper and lower membrane supports being composed of a polymeric material that wets said membrane so as to form a liquid impermeable seal therewith.

13. In an electrolytic cell for the production of chlorine and caustic from aqueous alkaline metal chloride solutions comprising at least one cathode spaced from an anode by a membrane, the improvement comprising a first membrane support plate cast in situ embedding an edge of the membrane, and a second membrane support plate cast in situ embedding a generally opposite edge of the membrane.

14. In an electrolytic cell comprising a cathode spaced from an anode by a membrane, the improvement comprising a first membrane support plate cast in situ to embed a portion of said membrane, and a second membrane support plate cast in situ to embed another portion of said membrane.

15. A method of supporting a preformed membrane in an electrolytic cell comprising casting in situ support plates about the open edges of the membrane.

* * * * *

UNITED STATES PATENT AND TRADEMARK OFFICE

CERTIFICATE OF CORRECTION

PATENT NO. : 4,288,310

DATED : September 8, 1981

INVENTOR(S) : Allan R. Knight and Indresh Mathur

It is certified that error appears in the above-identified patent and that said Letters Patent are hereby corrected as shown below:

Col. 3, line 63, "or" should read -- of --.

Col. 4, line 59, "diaphragm" should be deleted.

Signed and Sealed this

Second Day of February 1982

[SEAL]

*Attest:*

GERALD J. MOSSINGHOFF

*Attesting Officer*

*Commissioner of Patents and Trademarks*